US011083343B2

(12) United States Patent
Lee et al.

(10) Patent No.: US 11,083,343 B2
(45) Date of Patent: Aug. 10, 2021

(54) SIT-DOWN BATHING CONFIGURATION

(71) Applicant: CARE AUTOMATION HOLDINGS LIMITED, Central (HK)

(72) Inventors: Ka Shek Neville Lee, Sai Kung (HK); Sing-Kwong Samuel Hui, Mid-levels (HK)

(73) Assignee: CARE AUTOMATION HOLDINGS LIMITED, Central (HK)

( * ) Notice: Subject to any disclaimer, the term of this patent is extended or adjusted under 35 U.S.C. 154(b) by 0 days.

(21) Appl. No.: 16/741,708

(22) Filed: Jan. 13, 2020

(65) Prior Publication Data

US 2020/0146513 A1 May 14, 2020

Related U.S. Application Data

(63) Continuation of application No. PCT/CN2018/096761, filed on Jul. 24, 2018.

(60) Provisional application No. 62/537,479, filed on Jul. 27, 2017.

(51) Int. Cl.
*A47K 3/28* (2006.01)

(52) U.S. Cl.
CPC ..... *A47K 3/282* (2013.01)

(58) Field of Classification Search
CPC ..... A47K 3/28
USPC ..... 4/611, 605, 612, 596, 613
See application file for complete search history.

(56) References Cited

U.S. PATENT DOCUMENTS 3,758,894 A * 9/1973 Finley ..... A47K 3/122 4/546
5,373,591 A * 12/1994 Myers ..... A47K 3/122 4/560.1
5,517,704 A * 5/1996 Dagostino ..... A47K 3/122 4/480
5,966,750 A * 10/1999 Polanco ..... A47K 11/04 297/DIG. 4
5,978,983 A * 11/1999 Queen ..... A47K 3/006 4/555
6,279,178 B1 * 8/2001 Hill ..... A47K 3/122 4/560.1
7,506,385 B2 * 3/2009 Werschmidt ..... A61G 7/1003 4/561.1
D611,715 S * 3/2010 Werschmidt ..... A47K 3/122 D6/335
7,690,055 B2 * 4/2010 Hammer ..... A61G 7/1019 4/560.1
7,735,162 B2 * 6/2010 Ringholz ..... A47K 17/026 4/480
8,152,233 B2 * 4/2012 Wechter ..... A47K 3/122 297/124
D665,587 S * 8/2012 Lloyd ..... A47K 3/122 D6/335

(Continued)

FOREIGN PATENT DOCUMENTS

CN 204636190 U 9/2015
CN 105708678 B 12/2017
EP 1894553 B 3/2011

*Primary Examiner* — Lori L Baker

(57) ABSTRACT

A sit-down bathing configuration comprises includes: a seated shower device with an open area under its sitting surface, and a mobile bathing chair; wherein the seat of the mobile bathing chair can be fitted above the sitting surface of the seated shower device and the mobile bathing chair can be wheeled in and out of the shower device.

12 Claims, 9 Drawing Sheets

(56) References Cited

U.S. PATENT DOCUMENTS

| | | | | |
|---|---|---|---|---|
| D679,513 | S * | 4/2013 | Braverman | A61G 7/1059 D6/335 |
| 8,517,414 | B2 * | 8/2013 | Goldstein | A61G 7/1059 280/657 |
| 9,107,787 | B2 * | 8/2015 | Wechter | A47K 3/122 |
| 10,368,699 | B2 * | 8/2019 | Hart | A61G 7/1034 |
| 10,543,145 | B1 * | 1/2020 | McGuire | A61G 7/10 |
| 10,575,687 | B1 * | 3/2020 | Ehrenberg | A61G 7/1007 |
| 10,694,897 | B2 * | 6/2020 | Hart | A61G 7/1034 |
| 10,702,064 | B1 * | 7/2020 | Beattie | A61G 7/103 |
| 2009/0139021 | A1 | 6/2009 | cheng | |

* cited by examiner

SIT-DOWN BATHING CONFIGURATION

TECHNICAL FIELD

The present invention relates to a bathing room equipment, and more particularly to a sit-down bathing configuration comprising a seated shower device with an open area under its sitting surface and a mobile bathing chair, whereby the mobile bathing chair comprises a seat that can be fitted above the sitting surface and the mobile bathing chair can be wheeled in and out of the shower device.

BACKGROUND OF THE INVENTION

In the prior art, there are many examples of shower benches and seated bathing devices such as walk-in bath tubs. While bathing in a seated position is beneficial and safer, there is still considerable difficulty in transferring a patient into and out of a bathing unit.

The most conventional method of transporting a bather into a seated bathing device is to use a hoist. Hoists, however, are large, expensive, require wide hallways and are somewhat unwieldly to operate.

Another method of transporting a person into and out of a seated bathing device is to use a shower chair or wheel chair and rely on human effort (usually 2 or more people to do it safely) to lift the user into a bathing device. This method of relying on human effort is both dangerous for the bather and caretaker and is also an inefficient use of manpower.

Alternatively, a bather can be showered directly in a mobile bathing chair with a shower faucet. However, to do so would also require a lot of human effort, is much more prone to accidents and creates a large mess (water, soap, etc.). Thus, in a prior disclosure, a new automated and semi-open seated bathing device was introduced.

An automated bathing device is not only safer, but it also reduces the amount of manpower needed to assist in bathing and allows the bather to maintain his/her dignity during this very private activity.

Unfortunately, conventional bathing chairs are not compatible with such an automatic bathing device, or systems that already contain a seat; with the seat of such systems blocking the bathing chair. It is thus an intention of this disclosure to introduce a sit-down bathing configuration comprising a mobile bathing chair that is compatible with the aforementioned automatic bathing device, is easy to transport users into, is safer and aligns well with the bathing device.

SUMMARY OF THE INVENTION

It is an object of the present invention to provide a sit-down bathing configuration which is easy to transport users into, is safer and aligns well with the bathing device. The sit-down bathing configuration comprises: a seated shower device with an open area under its sitting surface, and a mobile bathing chair; wherein the seat of said mobile bathing chair can be fitted above the sitting surface of the seated shower device and the mobile bathing chair can be wheeled in and out of the shower device.

In some embodiments, said mobile bathing chair contains a slot or opening running from front to back, said slot being bounded on the top side by the seat of the bathing chair and on the bottom side by a rod or support structure.

In some embodiments, said slot of the mobile bathing chair is open in the back such that the sitting surface of the seated shower device can be fitted within said slot.

In some embodiments, said slot of the mobile bathing chair is blocked at its back opening by a lever that is pre-biased with a spring to a vertical position.

In some embodiments, whereupon such time that said sitting surface is fitted within said slot, the lever rotates to a more horizontal position to allow its insertion.

In some embodiments, said seat of the bathing chair can be tilted upward to allow for easier insertion of the sitting surface into said slot of the bathing chair.

In some embodiments, said seat of the bathing chair comprises rollers or wheels to reduce the friction during insertion of the sitting surface into said slot of the bathing chair.

In some embodiments, said sitting surface of the seated shower device has a slope for lifting said seat of the bathing chair and causing it to tilt.

In some embodiments, said seated shower device contains a foot tray with a bump that helps elevate said seat of the bathing chair above the sitting surface just as the roller or wheels contact the sitting surface.

In some embodiments, said tilting of said seat of the bathing chair contains a limiter so it can only be tilted slightly.

In some embodiments, said seat of the mobile bathing chair is supported by the sitting surface of the shower device.

In some embodiments, said rollers or wheels of said mobile bathing chair fit in a depression in the sitting surface when it of the seated shower device when fully inserted.

In some embodiments, said seated shower device is an automated bathing device.

In some embodiments, said seated shower device is fitted above a toilet.

In some embodiments, said mobile bathing chair comprises a lock for locking bathing chair to the seated shower device.

DETAILS OF THE INVENTION

The present invention involves a sit-down bathing configuration comprising a seated shower device and a mobile bathing chair. The mobile bathing chair is used to transport users into and out of the shower device easily without requiring the bather to be lifted into the system (usually manually).

To perform properly, the mobile bathing chair and seated shower device must meet a number of requirements and challenges:

1. The seat of the shower device must not block the seat of the mobile bathing chair;
2. The mobile bathing chair must align with the shower device so as to not block the water nozzles;
3. The mobile bathing chair must be able to secure itself within the shower device (for safety);
4. The mobile bathing chair must be stable and able to safely support the weight of the bather (cannot be flimsy);
5. The mobile bathing chair and entire sit-down bathing configuration must be easy to use and the bathing chair easy to push.

Figure 1:
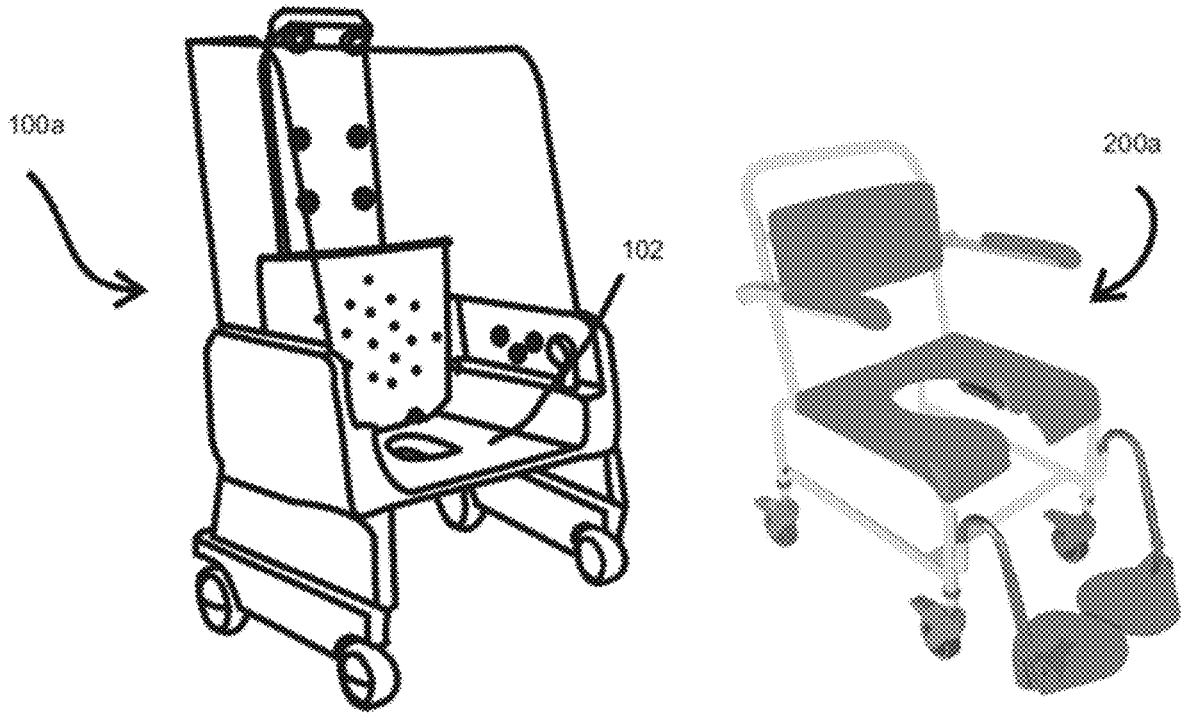
Fig.1 (Prior Art)
FIG. 1 shows a previously disclosed automated bathing device with a conventional shower chair.

FIG. 1 depicts the previously disclosed automated bathing device 100*a* with a conventional shower chair 200*a*. The automated bathing device 100*a* contains a sitting surface 102 that blocks the entry of the shower chair 200*a*.

Figure 2A:
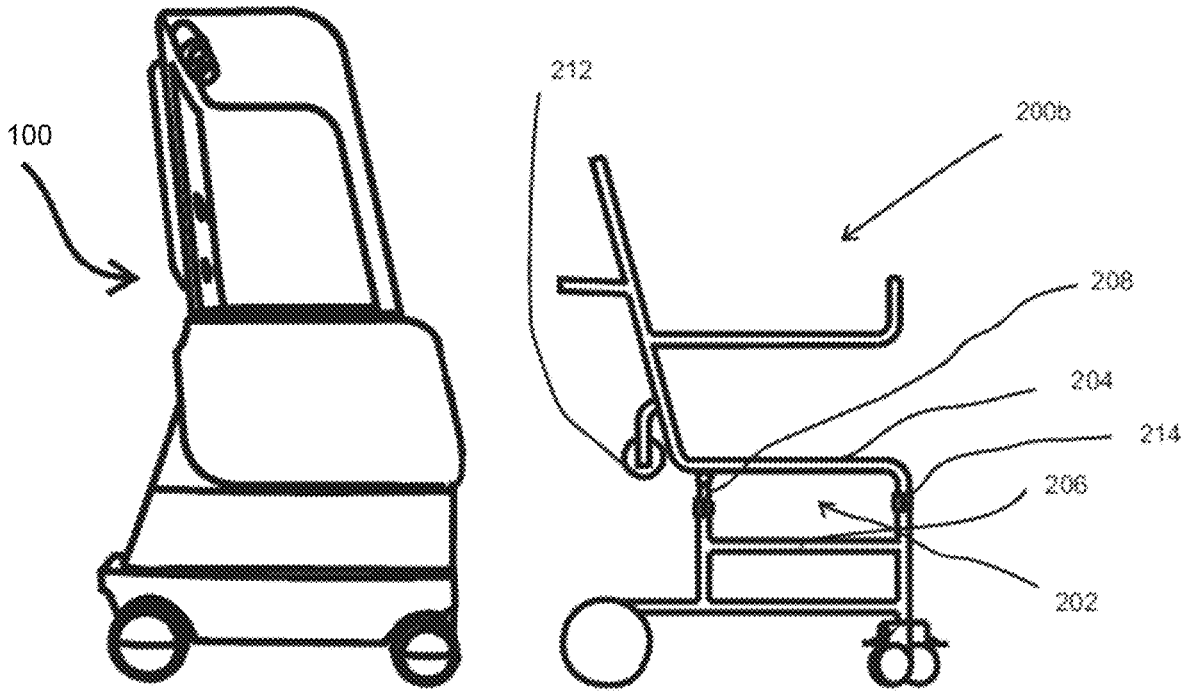
FIG. 2*a*, FIG. 2*b* and FIG. 2*c* show a side profile of one embodiment of the present invention involving the sit-down bathing configuration and the process of the sit-down bathing configuration being attached to an external apparatus.
Figure 2B:
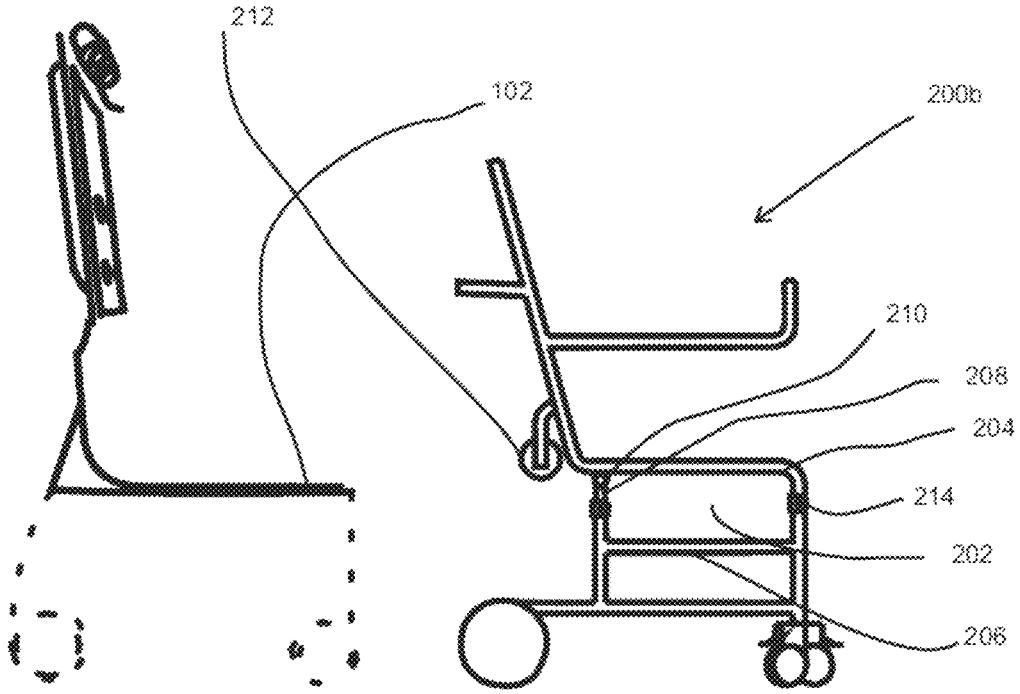
Figure 2C:
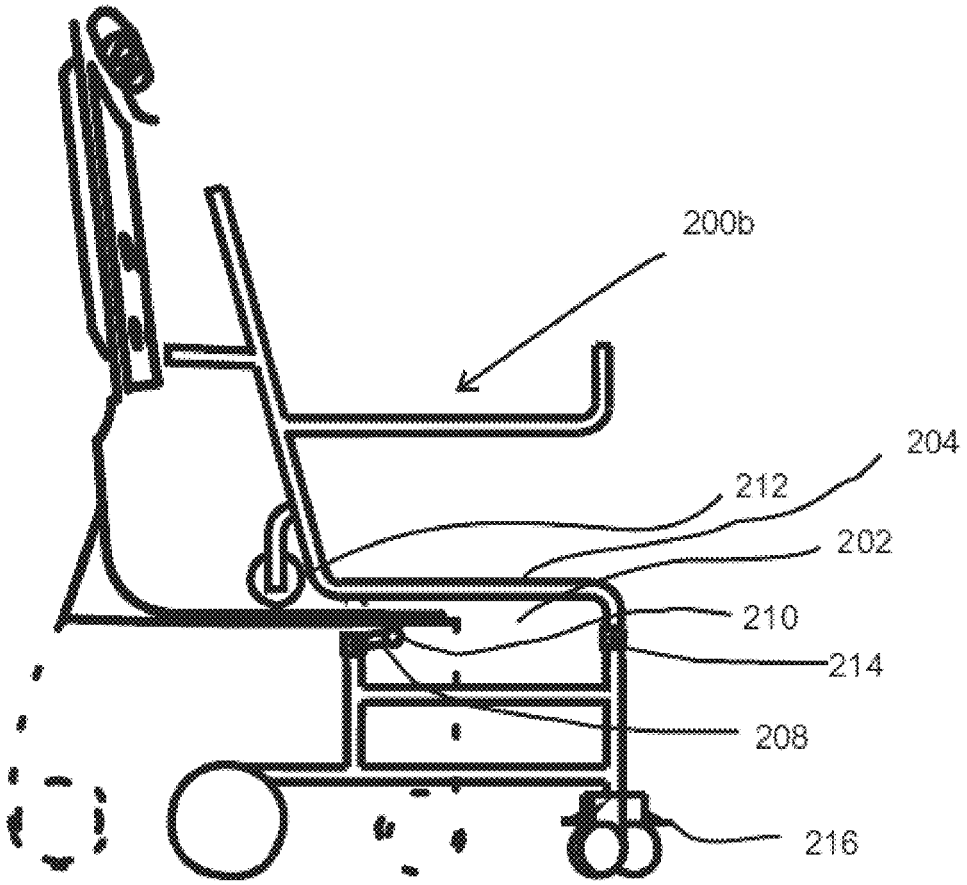
Figure 2D:
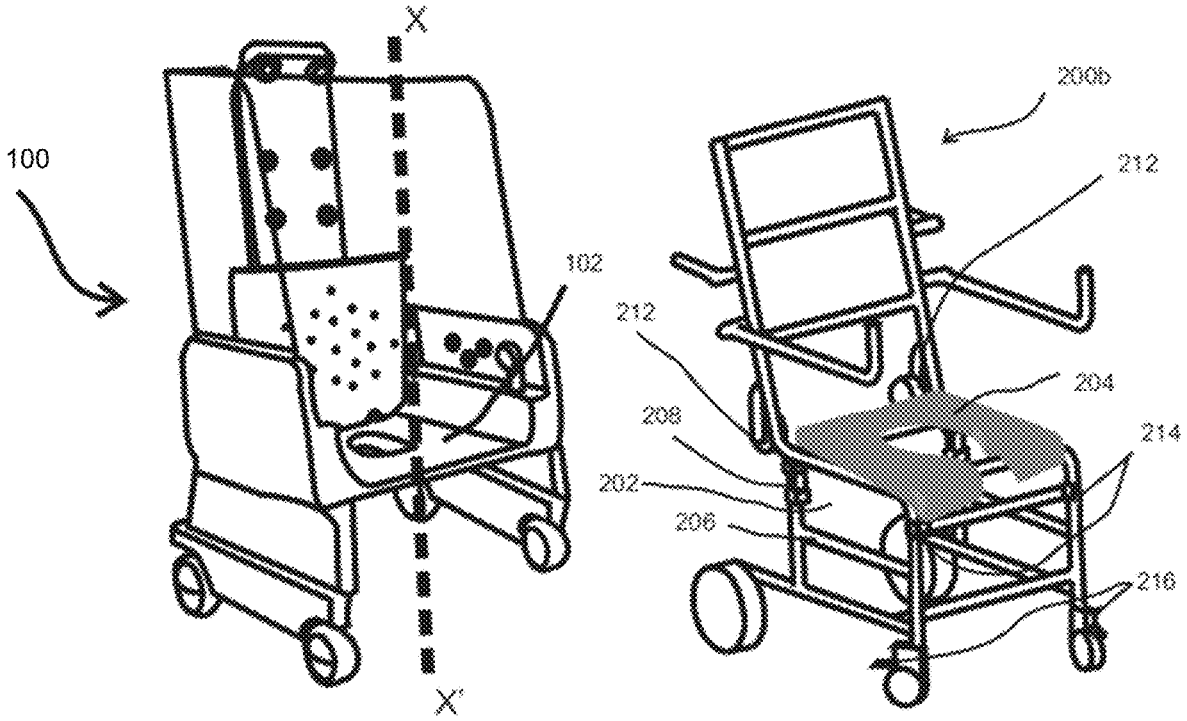
FIG. 2*d* shows another 3D diagram of the sit-down bathing configuration according to one embodiment of the present invention.

FIGS. 2*a*, 2*b* and 2*c* depict a side profile of a first embodiment of the current invention involving a sit-down bathing configuration comprising a seated shower device 100 and a mobile bathing chair 200*b*. In this example, the seated shower device is also the automated bathing device 100*a* (although it could be another similar device as well). In particular, FIGS. 2*b* and 2*c* reflect a cross-section of device 100*a* along lines X to X' of FIG. 2*d*.

Figure 3A:
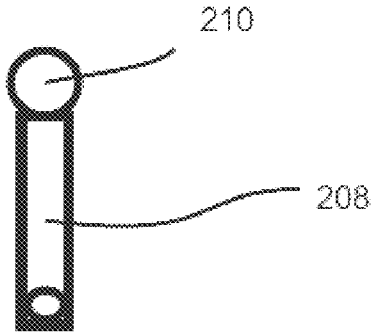
FIG. 3*a* shows a schematic diagram of a lever according to one embodiment of the present invention.

Preferably the mobile bathing chair contains a slot or opening 202 running from front to back, said slot 202 being bounded on the top side by the seat 204 of the bathing chair and on the bottom side by a rod or support structure 206. If enough rigid and durable enough materials were used to create this slot, it may be able support the weight of the user. However, another motivation for this invention is for it to be easy to use and thus a lighter weight for the shower chair is desirable. Thus, preferably, a lever 208 can be added to the slot of the mobile bathing chair at its back opening to support the weight at the back, as shown in FIGS. 3*a*-4*b*. More preferably, the lever 208 would be pre-biased vertically with a spring (not shown) to help support the weight of the bather. To reduce friction when pivoting, preferably the tip of the lever 208 is fitted with rollers or wheels 210, as shown in FIGS. 3*a*-3*b*.

When the mobile bathing chair 200*b* interfaces the seated shower device, preferably the sitting surface 102 of the seated shower device pushes away the lever 208 and fits within the slot 202 of the mobile bathing chair 200*b* such that the seat 204 of the mobile bathing chair is supported by the sitting surface 102. More preferably the back of the mobile bathing chair comprises "upper" rollers or wheels 212 for reducing the friction when the seat 204 of the mobile bathing chair slides against the sitting surface 102 of the seated shower device.

Figure 4A:
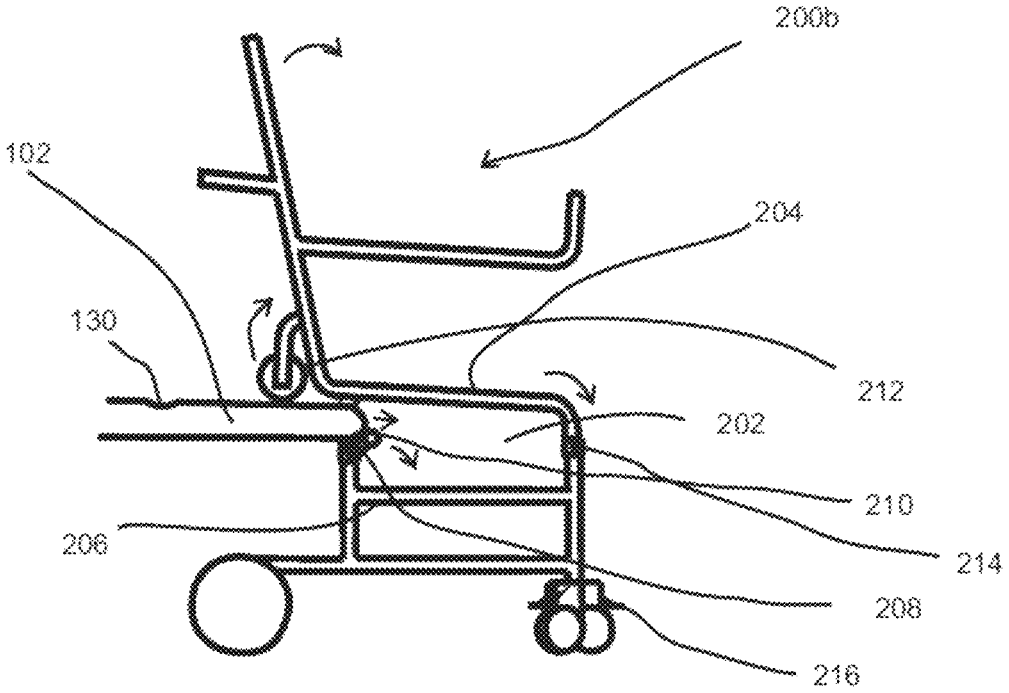
FIG. 4*a* shows a schematic diagram of the sit-down bathing configuration with the lever of FIG. 3*a* according to one embodiment of the present invention.
Figure 4B:
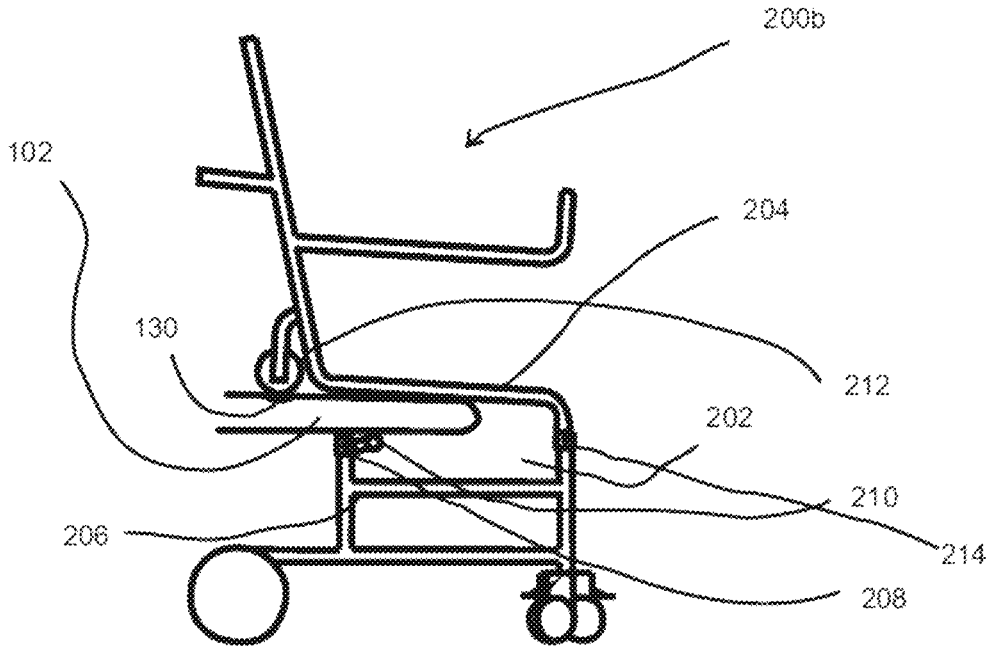
FIG. 4*b* shows another schematic diagram of the sit-down bathing configuration with the lever of FIG. 3*a* according to one embodiment of the present invention.

As in FIGS. 4*a* and 4*b*, optionally the seat of the mobile bathing chair 200*b* can pivot forward and upward along an axis 214 such so as to reduce the friction on the lever 208 (as it rotates when pushed by the sitting surface 102). The pivoting in FIGS. 4*a* and 4*b* are exaggerated so as to illustrate the pivoting concept. In this example, because the back part of the seat 204 lifts away from the lever 208, the lever 208 can pivot easily.

Figure 3B:
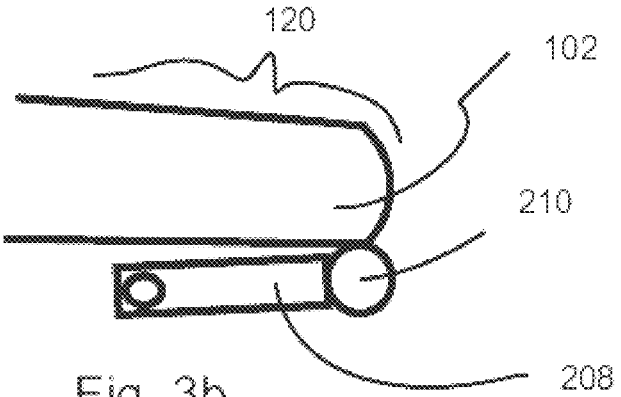
FIG. 3*b* shows a schematic diagram of the lever of FIG. 3*a* attached to a sitting surface according to one embodiment of the present invention.

Preferably the sitting surface 102 of the seated shower device 100*a* comprises a slight ramp 120 or incline as shown in FIG. 3*b* (as little as a few millimeters) to help raise the seat 204 of the seated shower device 204*a* away from its base as the "upper" rollers or wheels transverse up the ramp 120. Alternatively, along a tray or the ground in front of the seated shower device, there may also be a "bump" (not shown) to raise the level of the seat of the mobile bathing chair above the sitting surface of the seated shower device thus allowing a slight lifting seat when the bump has been traversed.

When the mobile shower chair 200*b* is fully inserted, preferably there is a tiny depression 130 for the "upper" roller or wheels 212 to sit in. This helps prevent the mobile shower chair 200*b* from moving. More preferably there is also a locking mechanism (not shown), possibly a hand lock, to lock the mobile shower chair to the device. This hand lock can be turned to lock the mobile shower chair to the shower chair. Alternatively, or additionally, there may be a foot brake 216 for locking the wheels of the mobile shower chair 200*b*. Optionally the handlebars 220 can be folded or lifted upwards (not shown).

Figure 5:
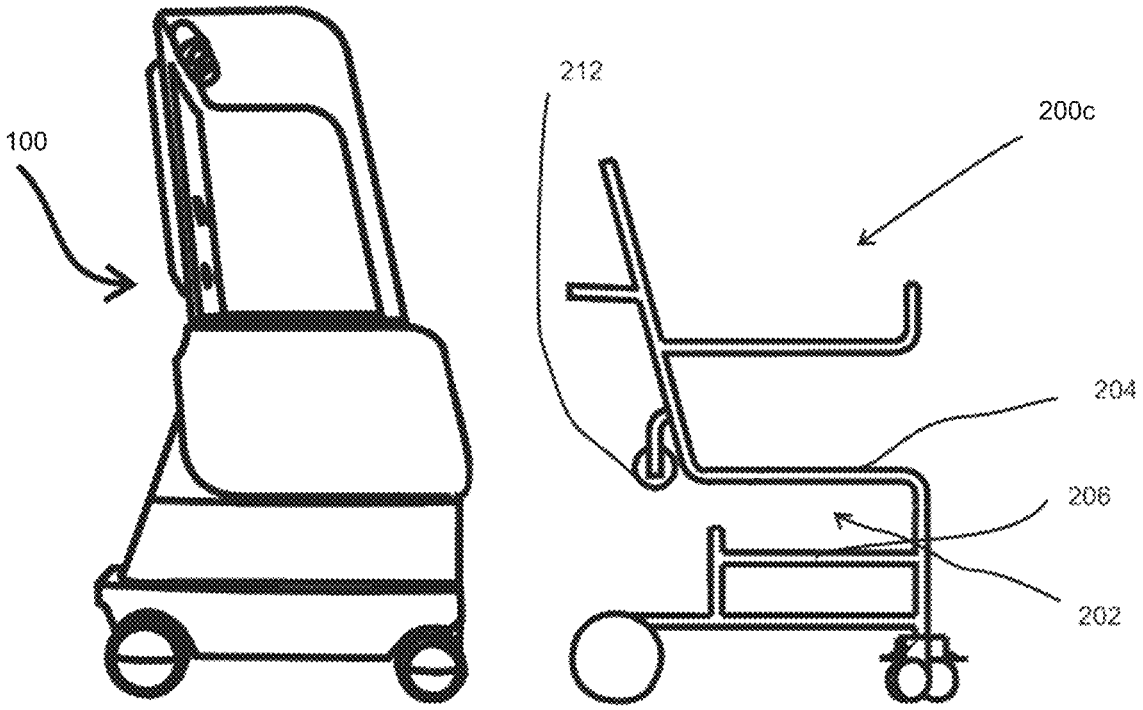
FIG. 5 shows another schematic diagram of the sit-down bathing configuration with a no-frills mobile shower chair (simplified version).

As in FIG. 5, a no-frills mobile shower chair 200*c*, according to the current invention, can also be provided. In this example, there is no lever 208 and there is no axis 214 where the seat can pivot forward. Optionally, the wheels 212 can also be eliminated.

In another aspect of the invention, the mobile shower chair 200*b* has apertures or openings in its back support or seat that align with the water nozzles of the seated shower device 100*a*.

What is claimed is:

1. A sit-down bathing configuration comprising:

a. a seated shower device with an open area under its sitting surface, and a b. a mobile bathing chair;

wherein the seat of said mobile bathing chair can be fitted above the sitting surface of the seated shower device and the mobile bathing chair can be wheeled in and out of the shower device;

wherein said mobile bathing chair contains a slot or opening running from front to back, said slot being bounded on the top side by the seat of the bathing chair and on the bottom side by a rod or support structure.

2. The sit-down bathing configuration as claimed in claim 1 wherein said slot of the mobile bathing chair is open in the back such that the sitting surface of the seated shower device can be fitted within said slot.

3. The sit-down bathing configuration as claimed in claim 2 wherein said slot of the mobile bathing chair is blocked at its back opening by a lever that is pre-biased to a vertical position.

4. The sit-down bathing configuration as claimed in claim 3 whereupon such time that said sitting surface is fitted within said slot, the lever rotates to a more horizontal position to allow its insertion.

5. The sit-down bathing configuration as claimed in claim 1 wherein said seat of the bathing chair can be tilted upward to allow for easier insertion of the sitting surface into said slot of the bathing chair.

6. The sit-down bathing configuration as claimed in claim 1 wherein said seat of the bathing chair comprises rollers or wheels to reduce the friction during insertion of the sitting surface into said slot of the bathing chair.

7. The sit-down bathing configuration as claimed in claim 6 wherein said seat of the mobile bathing chair is supported by the sitting surface of the shower device.

8. The sit-down bathing configuration as claimed in claim 6 wherein said rollers or wheels of said mobile bathing chair fit in a depression in the sitting surface when it is fully inserted into the seated shower device.

9. The sit-down bathing configuration as claimed in claim 1 wherein said sitting surface of the seated shower device has a slope for lifting said seat of the bathing chair and causing it to tilt.

10. The sit-down bathing configuration as claimed in claim 1 wherein said seated shower device is fitted above a toilet.

11. The sit-down bathing configuration as claimed in claim 1 wherein said mobile bathing chair comprises a lock for locking bathing chair to the seated shower device.

12. The sit-down bathing configuration as claimed in claim 1 wherein said mobile bathing chair has apertures or openings in its back support or seat that align with the water nozzles of the seated shower device.

* * * * *